United States Patent [19]

Holz et al.

[11] 4,139,593

[45] Feb. 13, 1979

[54] METHOD AND APPARATUS FOR MAKING MOLDED ARTICLES

[75] Inventors: William L. Holz, Rippey; Franklin C. Kinkade, Creston; Fred Robbins, Jefferson, all of Iowa

[73] Assignee: Mid-Iowa Concrete Products Company, Grand Junction, Iowa

[21] Appl. No.: 822,254

[22] Filed: Aug. 5, 1977

[51] Int. Cl.[2] ..... B28B 21/26

[52] U.S. Cl. ..... 264/333; 264/336; 425/262; 425/427; 425/444

[58] Field of Search ..... 264/333, 336; 425/262, 425/359, 444, 427

[56] References Cited

U.S. PATENT DOCUMENTS

| | | | |
|---|---|---|---|
| 831,781 | 9/1906 | Fisher | 425/359 |
| 1,545,255 | 7/1925 | Harrison | 425/359 |
| 3,649,146 | 3/1972 | Moore | 425/162 |
| 3,662,437 | 5/1972 | Long, Sr. | 425/147 |
| 3,989,432 | 11/1976 | Depka | 425/444 |

*Primary Examiner*—Richard B. Lazarus
*Assistant Examiner*—John McQuade
*Attorney, Agent, or Firm*—Zarley, McKee, Thomte, Voorhees & Sease

[57] ABSTRACT

A molding station having packer heads is positioned between a pair of stripping stations having ejectors and a mold box having first and second mold sections is movable between first and second positions with the ejectors at the one stripping station registering with the one mold section and the packer heads registering with the other mold section and at the second position the ejectors at the other stripping station registering with the other mold section and the packer heads registering with the first mold section. The completed molded product is ejected as the mold box is raised and the molded product is formed as the mold box is lowered. The mold box is raised and lowered between top and bottom table halves and when in the lowered position is movable between the first and second positions on rails having legs adapted to engage a stationary support when the lower table half is lowered a predetermined distance. Hydraulic cylinders raise and lower the top and bottom table halves together and the top half relative to the bottom half allowing the mold box to be moved between the first and second positions without interference from the table halves.

6 Claims, 10 Drawing Figures

METHOD AND APPARATUS FOR MAKING MOLDED ARTICLES

BACKGROUND OF THE INVENTION

The concrete tile making machines presently available are complicated and inefficient in their operation. Representative machines are disclosed in U.S. Pat. No. 3,662,437 wherein a table rotates 90° in opposite directions for molds to alternately register with ejectors and packer heads. The table includes four molds around the periphery. U.S. Pat. No. 3,649,146 illustrates a machine where molding occurs on one side while ejecting occurs on another side requiring rotational movement of 180° with only two operations being performed at any given time.

SUMMARY OF THE INVENTION

In accordance with the present invention three stations are provided with packer heads being positioned at the center station and ejectors on either side thereof. A mold box is shuttled back and forth and includes two sections each of which are being worked upon each time the mold box is raised and lowered. In the first position the ejectors at one stripping station register with one section of the mold box and the packer heads register with the other mold box section and in the second position the ejectors at the other stripping station register with the other mold section while the packer heads register with the first mold box section. A hydraulic cylinder moves the mold box between the first and second positions and hydraulic cylinders raise and lower the mold box between top and bottom table halves which are movable together with the top half being additionally movable relative to the bottom half to allow for horizontal movement of the mold box between the first and second positions. When the mold box is raised it is supported by the lower half of the table and when it is lowered it is supported on a stationary support engaged by rail legs of the track on which the mold box is supported in moving between the first and second positions.

DESCRIPTION OF THE PREFERRED EMBODIMENT

Figure 1:
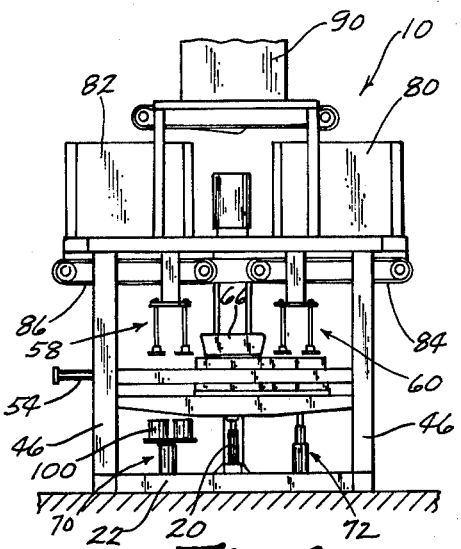
FIG. 1 is a side elevational view of the concrete tile making machine of this invention.
Figure 3:
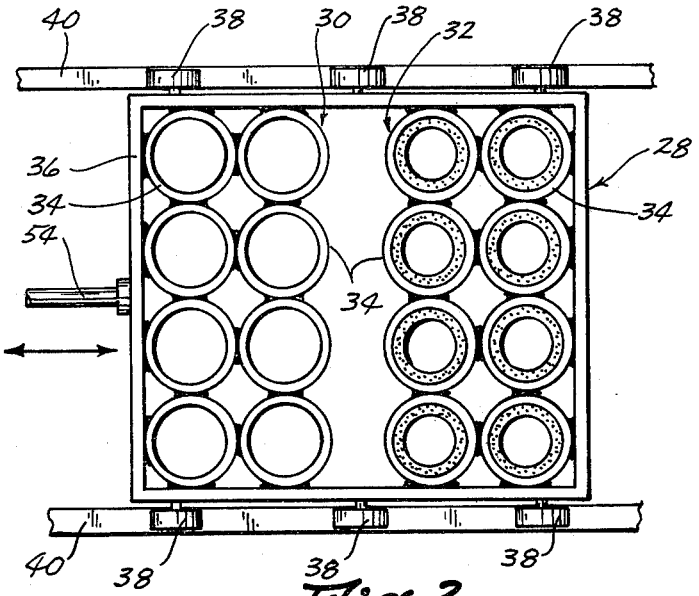
FIG. 3 is a cross-sectional view taken along line 3—3 in FIG. 2, showing the mold box movable between first and second positions between the table halves.
Figure 4:
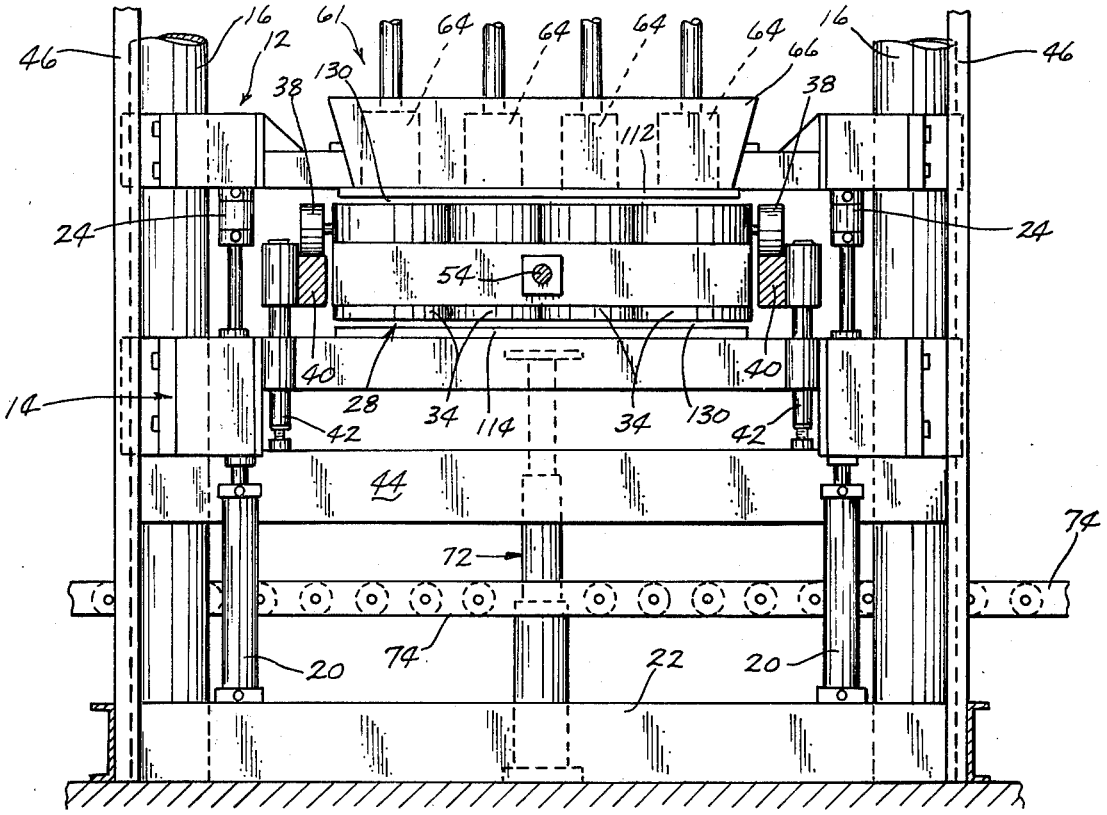
FIG. 4 is a cross-sectional view taken along line 4—4 in FIG. 2.

The concrete tile making machine of this invention is referred to generally in FIG. 1 by the reference numeral 10 and as seen in FIG. 4, includes top and bottom table halves 12 and 14 slidably movable on guide posts 16 at opposite ends thereof. Oppositely disposed hydraulic cylinders 20 disposed on a base frame 22 are provided for raising and lowering the table halves 12 and 14 while a pair of oppositely disposed hydraulic cylinders 24 raise and lower the top table half 12 relative to the bottom half 14.

Figure 5:
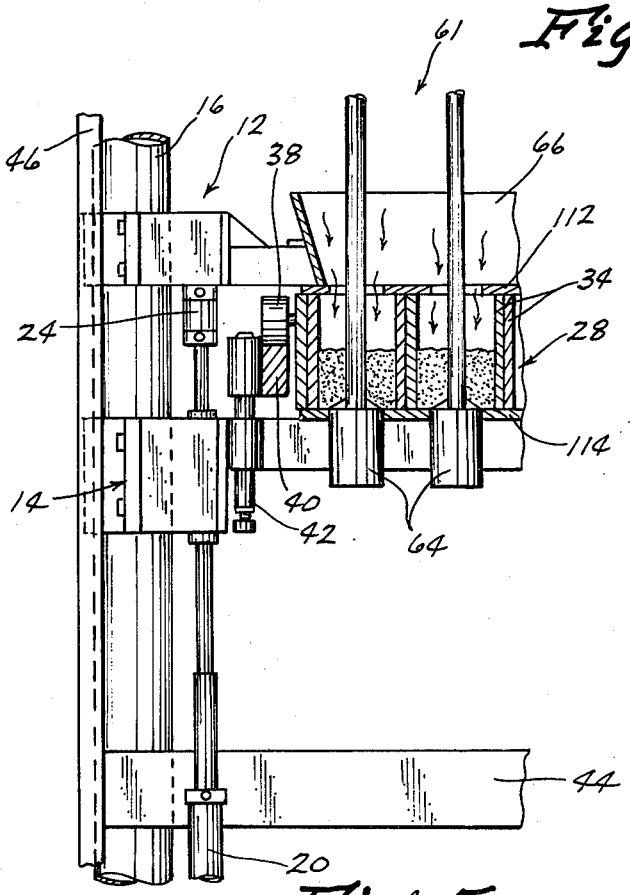
FIG. 5 is a partially sectional fragmentary side elevational view similar to FIG. 4 but showing the table in its fully raised position.
Figure 7:
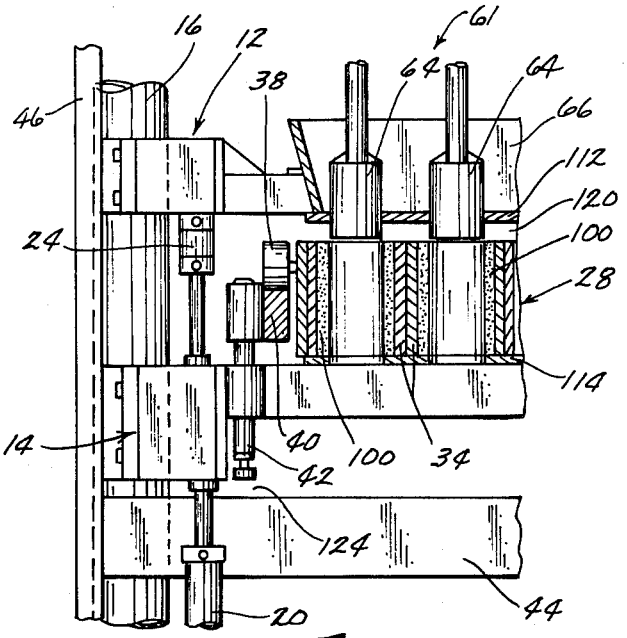
FIG. 7 is a partially sectional view similar to FIG. 5 but showing the top and bottom table halves lowered to three-quarters of an inch of their bottom position.
Figure 9:
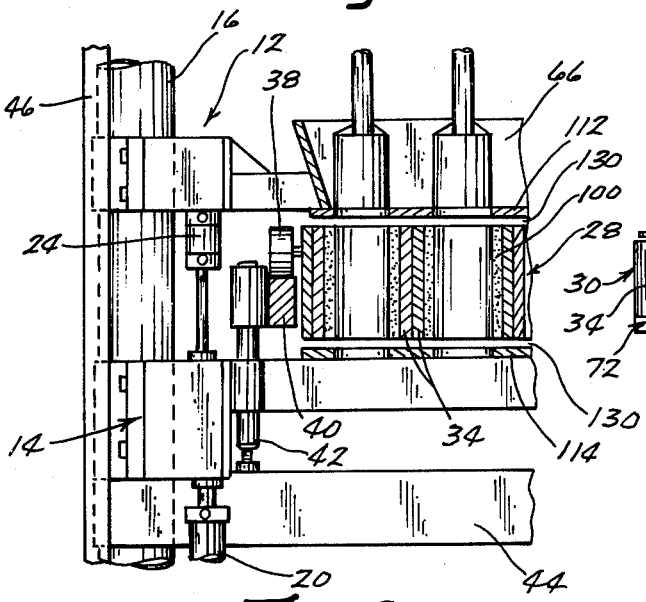
FIG. 9 is a partially sectional fragmentary side elevation view similar to FIG. 7 but showing the bottom table half fully lowered and with the mold box being supported on a stationary support in spaced relationship to the top and bottom table halves.

A mold box 28 includes mold sections 30 and 32 each having eight mold forms 34 secured together by a frame 36 having laterally disposed rollers 38 engaging side rails 40 which in turn have downwardly extending legs 42 adapted to supportingly engage channel frame members 44 extending between corner frame posts 46. Legs 42 are telescopically secured to the bottom table half 14 for vertical movement therewith as shown in FIGS. 5 and 7 and for vertical movement relative thereto as shown in FIG. 9.

Figure 2:
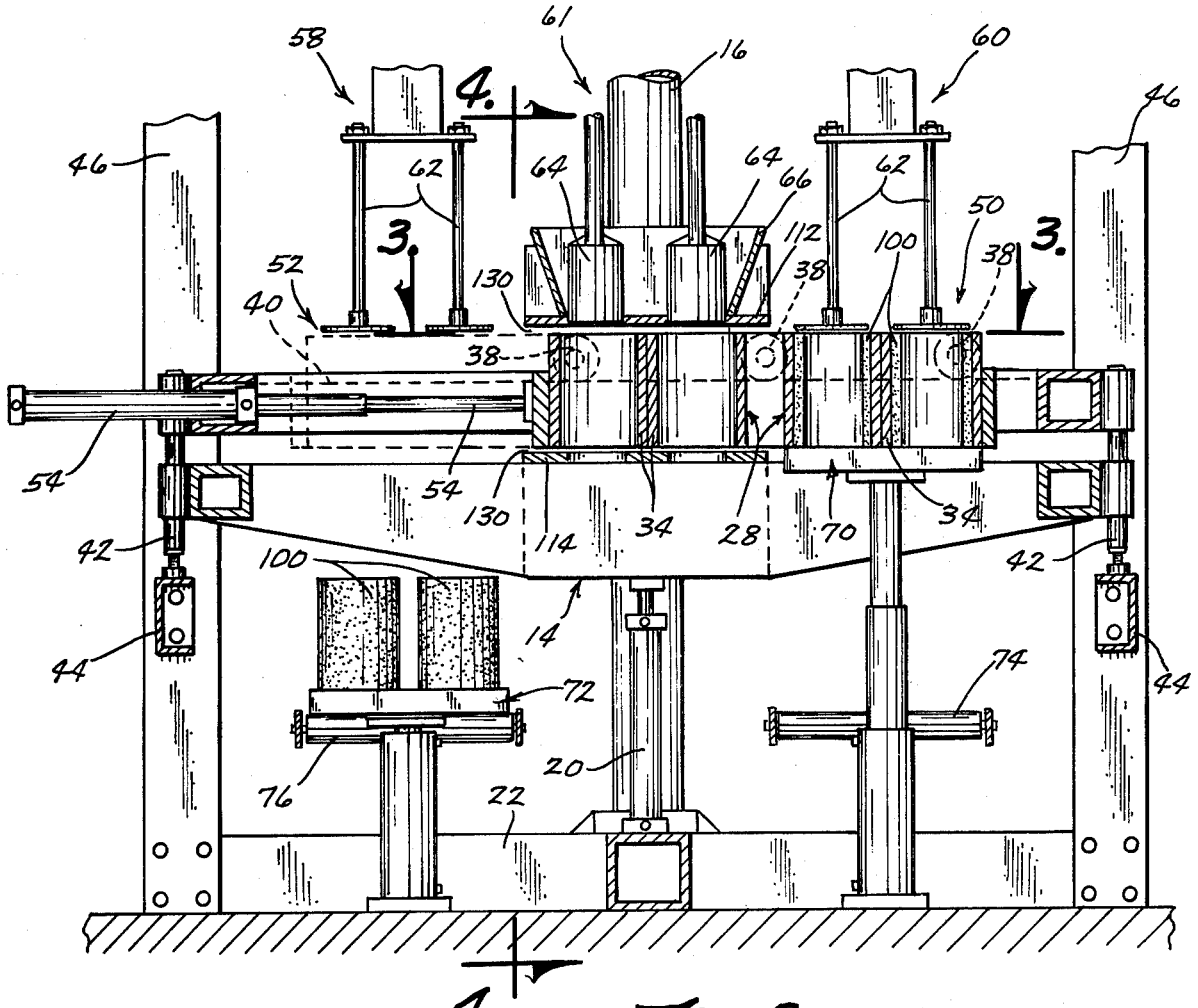
FIG. 2 is a enlarged fragmentary side elevation view thereof with parts shown in section.

The mold box 28 is movable between the solid and dashline positions 50 and 52, respectively, shown in FIG. 2 by a shuttle cylinder 54.

Figure 6:
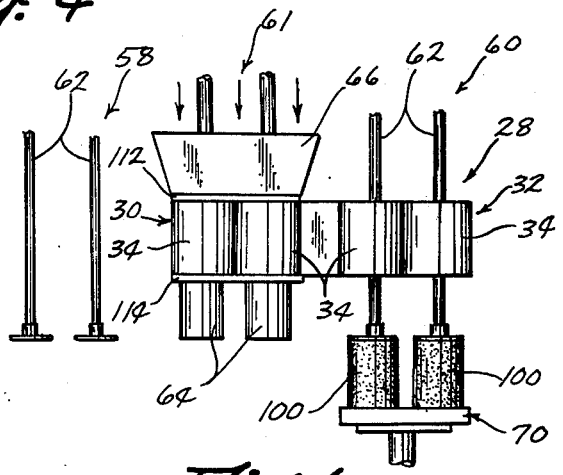
FIG. 6 is a side elevation view of the packer heads and ejectors relative to the mold box when the table is in the position of FIG. 5.
Figure 8:
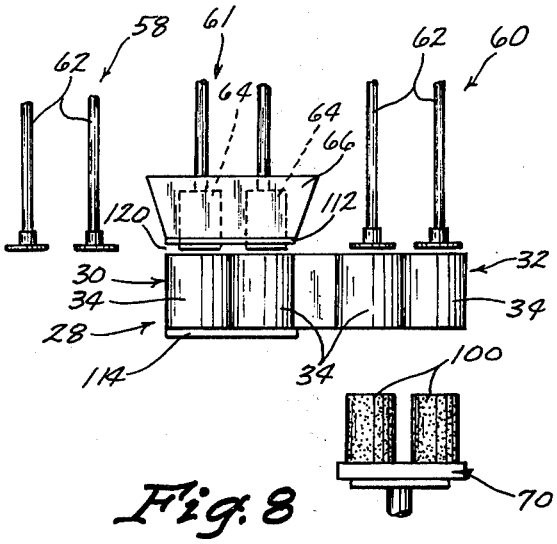
FIG. 8 is a side elevation view of the ejectors and packer heads showing their relationship to the mold box when in the position illustrated in FIG. 7.
Figure 10:
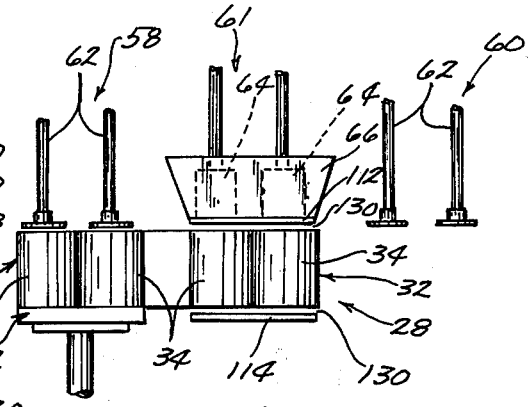
FIG. 10 is a side elevation view of the ejectors and packer heads relative to the mold box when in the position illustrated in FIG. 9 with the mold box having been moved to its second position.

As seen in FIG. 6, a pair of ejector stations 58 and 60 are provided on opposite sides of a molding station 61 with ejectors 62 being provided at the ejector stations and packer heads 64 extending through a hopper 66 at the molding station. A pair of hydraulically operated elevator platforms 70 and 72 are seen in FIGS. 8 and 10 and are movable between raised and lowered positions as seen in FIG. 2. When in their lowered positions they are coplaner with the top surface of conveyers 74 and 76 onto which completed mold products are placed for removal from the machine.

Ingredients for making the concrete are fed from bins 80 and 82 onto feeder conveyers 84 and 86, respectively, as seen in FIG. 1. A centrally disposed feeder 90 is associated with the conveyer 92.

In operation it is seen in FIGS. 1–4 that the shuttle cylinder 54 has just moved the mold box 28 from the dashline position 52 to the solid-line position 50 with the mold section 32 aligned with the ejectors 62 at the right-hand stripping station and the packer heads 64 are aligned with the mold section 30. The mold section 32 includes formed tile products 100. In FIGS. 5 and 6 the top table half 12 has been lowered by the cylinder 24 relative to the bottom table half 14 and both table halves have been raised by the cylinder 20 to the uppermost position with the packer heads 64 extending through the molds 34 in the mold section 30. Material from the feeders 80, 82 and 90 have been fed into the hopper 66 and the molds 34, as seen at 110. The top and bottom mold plates 112 and 114, respectively, retain the working materials 110 within the molds 34 but allow the packer head 64 to pass therethrough. When the top and bottom tables 12 and 14 were raised the righthand ejectors 62 strip the completed tile 100 from the mold section 32 of the mold box 28. The completed tile 100 are supported on the platform 70 ready to be returned to the conveyer table 74 to be removed from the machine.

Next, as seen in FIGS. 7 and 8, the top and bottom table halves 12 and 14 are lowered to within three-quarters of an inch of the bottommost position (FIGS. 9 and 10) and the top half 12 is raised by the cylinder 24 to provide a half inch clearance at 120 between the top mold plate 112 and the top of the mold box 28. A space of one-half inch exists between the lower ends of the rail legs 42 and the stationary channel support 44, as indicated at 124. Next, as seen in FIGS. 9 and 10, both top and bottom table halves 12 and 14 are lowered three-quarters of an inch to the bottommost position leaving a quarter of an inch above and below the mold box 28 as indicated at 130 in FIG. 9. The lower ends of the rail legs 42 are now in contact with the channel frame member 44. The shuttle cylinder 54 may now be operated to move the mold box 28 to the left position, as indicated in FIG. 10 with the mold section 30 registering with the ejectors 62 and the packer heads 64 registering with the mold section 28. The elevator platform 72 is ready to receive the completed tile 100 from the mold section 30 when the mold box 28 is raised to the uppermost position. The tile, when ejected, are then deposited onto the conveyer 76, as seen in FIG. 2 for removal from the machine and the cycle is repeated.

We claim:

1. A method of making molded articles comprising the steps of, providing a molding station between a pair of stripping stations with a two-section mold movable between first and second positions such that at one position ejector means at one stripping station registers with one mold section and packer head means at said molding station registers with the other mold section and at the other position ejector means at the other stripping station registers with the other mold section and said packer head means registers with said one mold section, moving said mold to said first position, raising the mold relative to said packer head means and said ejector means and ejecting a molded product from said one mold section while extending the packer head means through the other mold section, filling said other mold section, and lowering the mold thereby forming a molded product in said other mold section, moving said mold to said second position, raising the mold relative to said packer head means and said ejector means and ejecting a molded product from said other mold section while extending the packer head means through the one mold section, filling said one mold section, and lowering the mold thereby forming a molded product in said one mold section, said lowering of said mold including lowering said mold between top and bottom table halves until said mold is substantially clear of said packer head means and said ejector means, then raising said top half relative to said bottom half and said mold and lowering said top and bottom halves until said mold is supported on a stationary support independently of said table halves and clear of said table halves whereby said mold may be moved between said first and second positions.

2. An apparatus for making molded articles comprising, a pair of stripping stations, a molding station positioned between said pair of stripping stations, ejector means at each stripping station, packer head means at said molding station, mold means having two sections movable between first and second positions, first power means for moving said mold means between said first and second positions, and second power means for moving said mold means vertically at each position whereby at said first position ejector means at one stripping station registers with one section of said mold means and said packer head means registers with the other section of said mold means and at said second position ejector means at the other stripping station registers with the other mold means section and said packer head means registers with said one mold means section, said ejector means and packer head means being vertically stationary and said second power means being adapted to raise and lower said mold means relative to said ejector means and said packer head means, top and bottom table halves between which said mold means is horizontally movable for moving between said first and second positions, said second power means including means for raising said top and bottom table halves together and said top half relative to said bottom half, a stationary support, said bottom table half supporting support rails and said mold means being movable on said support rails which have support legs positioned for engaging said stationary support upon said bottom table half being lowered a predetermined distance thereby allowing said mold means to be moved between said first and second positions on said rails independently of said bottom table half.

3. An apparatus for making molded articles comprising, a pair of stripping stations, a molding station positioned between said pair of stripping stations, ejector means at each stripping station, packer head means at said molding station, mold means having two sections movable between first and second positions, first power means for moving said mold means between said first and second positions and second power means for moving said mold means vertically at each position, whereby at said first position ejector means at one stripping station registers with one section of said mold means and said packer head means registers with the other section of said mold means and at said second position ejector means at the other stripping station registers with the other mold means section and said packer head means registers with said one mold means section, said ejector means and packer head being vertically stationary and said second power means being adapted to raise and lower said mold means relative to said ejector means and said packer head means, and top and bottom table halves between which said mold means is horizontally movable for moving between said first and second positions, said second power means including means for raising said top and bottom table halves together and said top half relative to said bottom half.

4. The apparatus according to claim 3 wherein said second power means includes lower power means for raising and lowering said top and bottom table halves in unison relative to said packer head means and upper power means for raising and lowering said top table half relative to said bottom table half to respectively release and secure said mold means between said table halves.

5. The apparatus of claim 4 wherein said mold means, when released between said table halves, is horizontally and linearly movable between said first and second positions by said first power means.

6. The apparatus of claim 5 wherein said upper, lower and first power means comprise upper, lower and first hydraulic cylinder units.

* * * * *